United States Patent [19]

Kim

[11] Patent Number: 4,473,725

[45] Date of Patent: Sep. 25, 1984

[54] MODULAR JOYSTICK CONTROLLER

[75] Inventor: Syng N. Kim, Hoffman Estates, Ill.

[73] Assignee: Wico Corporation, Niles, Ill.

[21] Appl. No.: 436,678

[22] Filed: Oct. 26, 1982

[51] Int. Cl.[3] ..... H01H 25/04

[52] U.S. Cl. ..... 200/6 A; 200/17 R; 200/303

[58] Field of Search ..... 200/5 R, 6 A, 17 R, 200/18, 303, 153 K

[56] References Cited

U.S. PATENT DOCUMENTS

| | | | |
|---|---|---|---|
| 2,857,485 | 10/1958 | Brooks | 200/6 A |
| 2,896,034 | 7/1959 | Nolden et al. | 20/6 A X |
| 4,124,787 | 11/1978 | Aamoth et al. | 200/6 A |
| 4,171,470 | 10/1979 | Gettig | 200/6 A |
| 4,349,708 | 9/1982 | Asher | 200/6 A |
| 4,382,166 | 5/1983 | Kim | 200/18 X |

*Primary Examiner*—J. R. Scott

*Attorney, Agent, or Firm*—Emrich & Dithmar

[57] ABSTRACT

A joystick controller includes an enclosure including unitary one-piece cover and bottom parts. The cover part has structure defining a plurality of receptacles respectively receiving direction-control switches and a handle support module therein, while the bottom part has a plurality of projections which cooperate with the receptacles to hold the direction-control switches and the support module immovably in place. The support module is a multi-part assembly which is assembled without the use of fasteners and tiltably supports the handle for actuation of the direction control switches. Two fire control switches are also mounted in the housing on support pins integral with the cover part.

23 Claims, 11 Drawing Figures

MODULAR JOYSTICK CONTROLLER

BACKGROUND OF THE INVENTION

The present invention relates to a joystick controller for electric switches, of the type which is used for controlling the operation of certain electronic games and the like. In particular, this invention is an improvement of the type of joystick controller disclosed in my copending U.S. application Ser. No. 327,261, filed Dec. 3, 1981, now U.S. Pat. No. 4,382,166.

Prior joystick controllers, including that disclosed in the aforementioned application, include a housing enclosing a plurality of switches which may include, for example, direction control switches and a fire control switch, and handle means tiltably mounted on the housing for movement to actuate the direction control switches. The handle may include a push button for actuating the fire control switch. These prior joystick controllers are characterized by a large number of discrete parts held together by a plurality of fasteners such as screws or the like. Accordingly, the manufacture and assembly of these devices is costly and time consuming.

SUMMARY OF THE INVENTION

It is a general object of the present invention to provide an improved joystick controller which avoids the disadvantages of prior joystick controllers while affording additional structural and operating advantages.

An important object of the invention is the provision of a joystick controller which is of simple and economical construction.

In connection with the foregoing object, it is another object of this invention to provide a joystick controller of the type set forth in which the several parts are held together in an assembled configuration with a minimum number of fasteners.

It is another object of this invention to provide a joystick controller of the type set forth which provides a modular construction of key portions of the assembly.

In connection with the foregoing objects, it is still another object of this invention to provide a joystick controller of the type set forth, in which the parts of each module are held together without the use of fasteners.

These and other objects of the invention are attained by providing a joystick controller including an enclosure, direction control switches in the enclosure and handle means coupled to the enclosure for actuating the switches, the improvement comprising: a support module mounted as a unit within the enclosure for tiltably supporting the handle means, the support module including a housing having a passage therethrough for accommodating the handle means in a mounted configuration, and flexible diaphragm means fixedly mounted in the housing and engaging the handle means in supporting relationship therewith in the mounted configuration thereof for accommodating universal tilting movement of the handle means for actuation of the switches.

The invention consists of certain novel features and a combination of parts hereinafter fully described, illustrated in the accompanying drawings, and particularly pointed out in the appended claims, it being understood that various changes in the details may be made without departing from the spirit, or sacrificing any of the advantages of the present invention.

BRIEF DESCRIPTION OF THE DRAWINGS

For the purpose of facilitating an understanding of the invention, there is illustrated in the accompanying drawings a preferred embodiment thereof, from an inspection of which, when considered in connection with the following description, the invention, its construction and operation, and many of its advantages should be readily understood and appreciated.

DESCRIPTION OF THE PREFERRED EMBODIMENT

Figure 1:
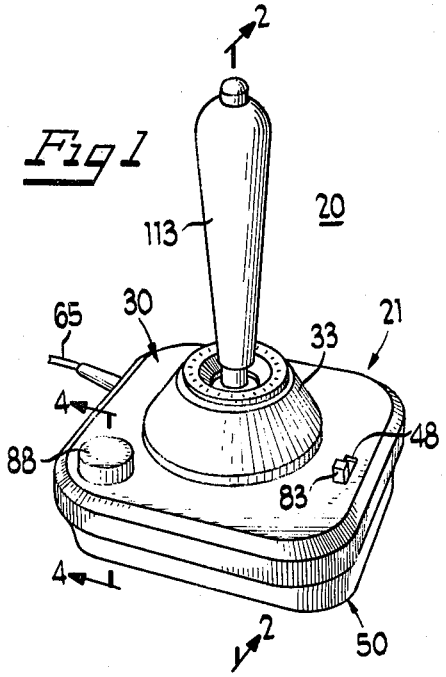
FIG. 1 is a perspective view of a joystick controller constructed in accordance with and embodying the features of the present invention.
Figure 2:
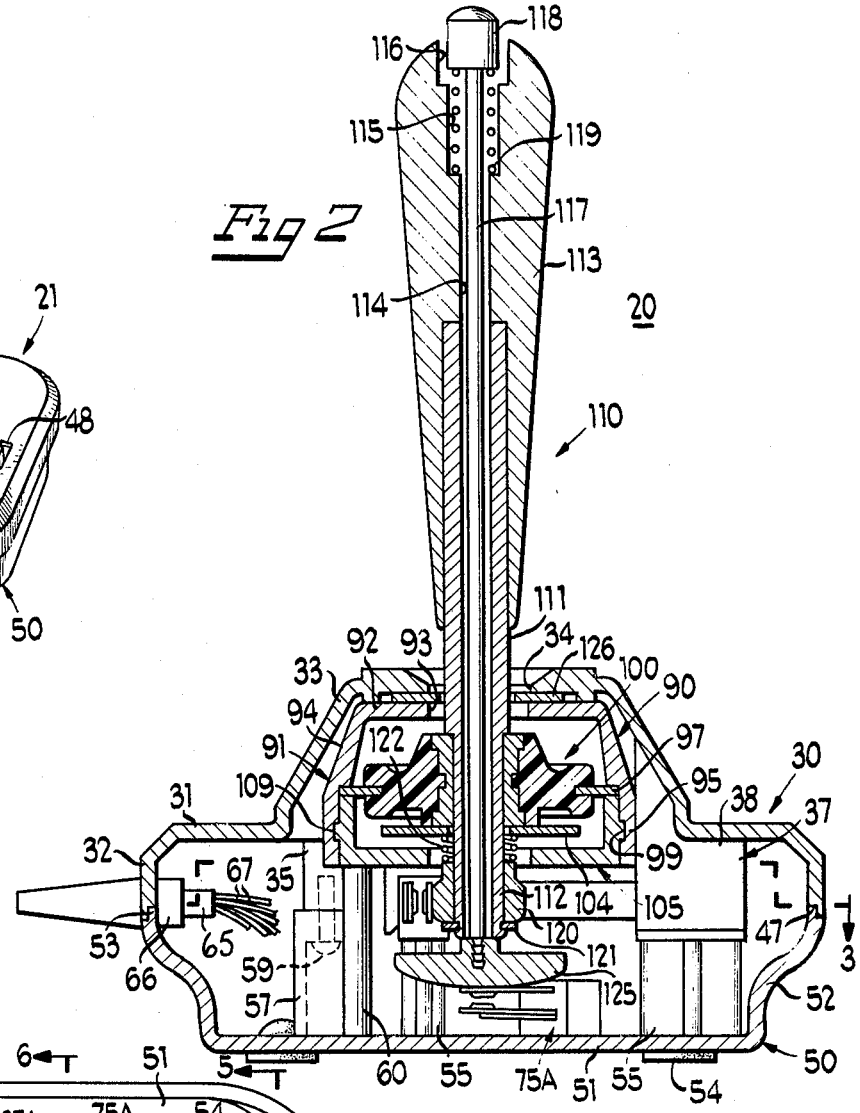
FIG. 2 is an enlarged view in vertical section taken along the line 2—2 in FIG. 1.

There is illustrated in FIG. 1 a joystick controller, generally designated by the numeral 20, constructed in accordance with and embodying the features of the present invention. The joystick controller 20 includes a two-part outer casing or enclosure 21 including a cover or top 30 and a bottom or base 50 which are fitted together to form a closed casing. Referring more particularly to FIGS. 2, 4–9 and 11 of the drawings, the cover 30 is of unitary, one-piece construction, preferably being molded of a suitable plastic material, and includes a generally rectangular top wall 31 provided around the perimeter thereof with a depending skirt or side wall 32. Integral with the top wall 31 centrally thereof and projecting upwardly therefrom is a frustoconical turret 33 having a circular aperture 34 at the upper end thereof.

Figure 3:
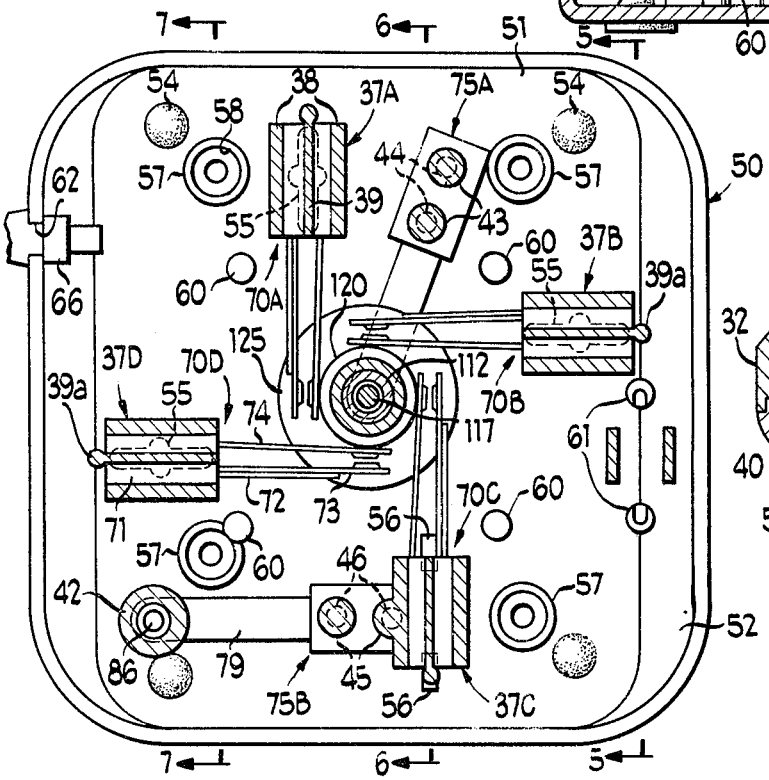
FIG. 3 is a view in horizontal section taken along the line 3—3 in FIG. 2.

Integral with the top wall 31 and depending therefrom are four cylindrical attachment lugs 35, each having an internally threaded bore extending axially thereinto from the distal end thereof. Also integral with the inner surface of the turret 33 adjacent to the lower end thereof and depending therefrom are three cylindrical positioning lugs 36. Formed on the inner surface of the top wall 31 at substantially equiangularly spaced apart locations along the perimeter of the turret 33 are four receptacles 37, differentiated in certain of the drawing figures by the suffixes, A, B, C, and D. Each of the receptacles 37 is defined by a pair of laterally spaced-apart rectangular walls 38 and a rectangular seat rib 39 disposed midway between the walls 38 and depending less than half the length thereof (see FIGS. 3, 5, 8, and 9). Provided at the outer end of each of the seat ribs 39 is a short cylindrical retaining pin 39*a* (see FIG. 3).

Figure 4:
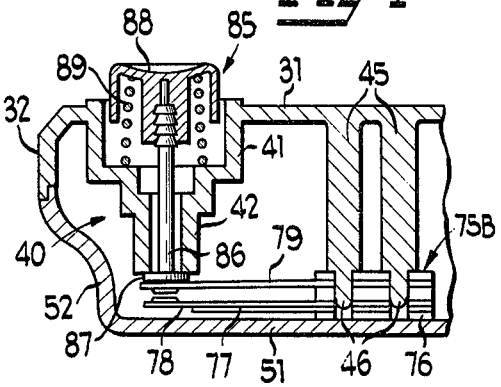
FIG. 4 is an enlarged fragmentary view in vertical section taken along the line 4—4 in FIG. 1.
Figure 5:
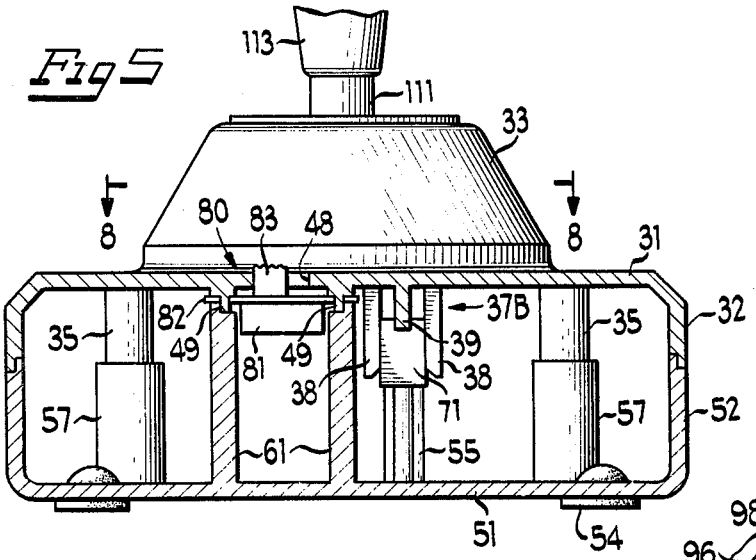
FIG. 5 is a fragmentary view in vertical section taken along the line 5—5 in FIG. 3.
Figure 8:
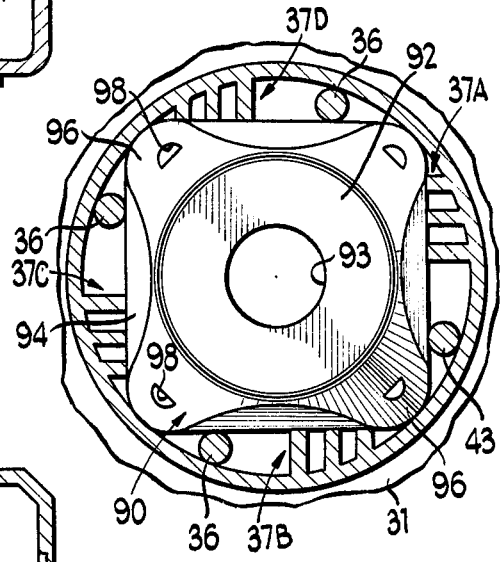
FIG. 8 is a fragmentary view in horizontal section taken along the line 8—8 in FIG. 5.
Figure 6:
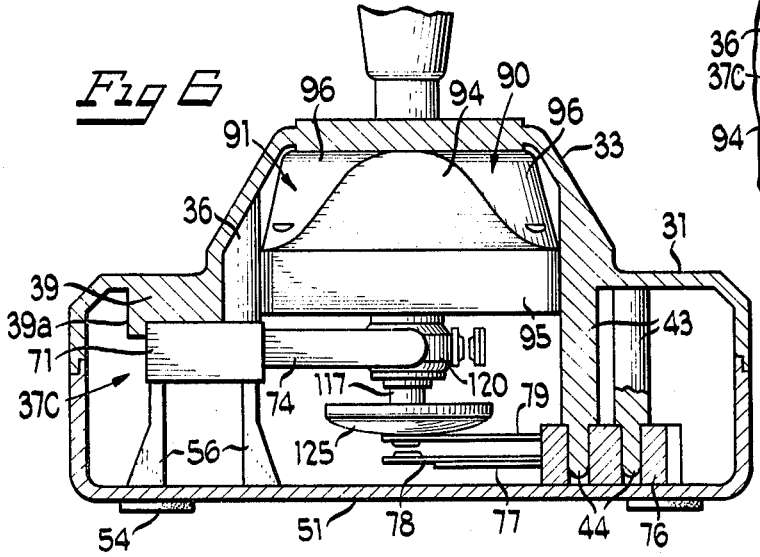
FIG. 6 is a fragmentary view in vertical section taken along the line 6—6 in FIG. 3.
Figure 9:
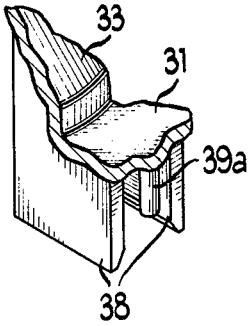
FIG. 9 is a fragmentary perspective view of one of the direction control switch receptacles illustrated in FIG. 8.
Figure 7:
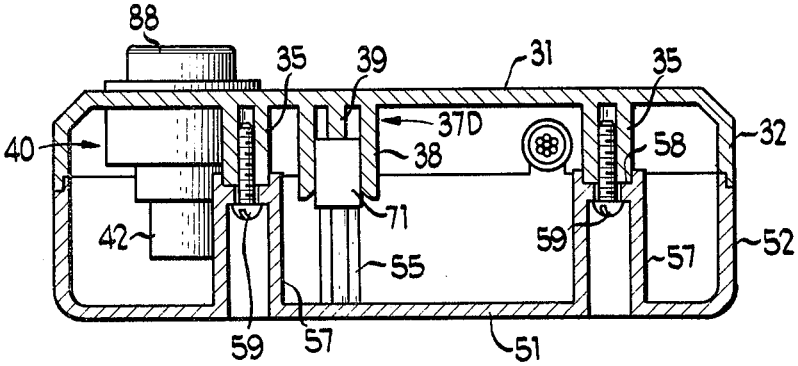
FIG. 7 is a fragmentary view in vertical section taken along the line 7—7 in FIG. 3.
Figure 10:
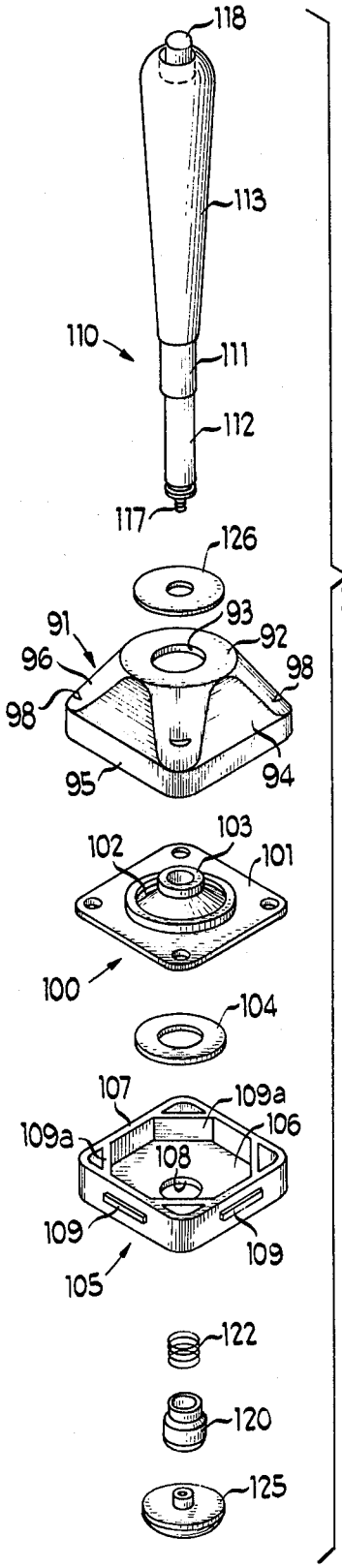
FIG. 10 is an exploded view of the handle assembly and support module of the present invention.

Integral with the top wall 31 adjacent to one corner thereof and depending therefrom is a cylindrical bushing, generally designated by the numeral 40, having a relatively large diameter outer or upper end 41 and a reduced diameter inner or lower end 42 (see FIGS. 4, 7, and 10). Also integral with the top wall 31 and depending therefrom are a pair of elongated posts 43, each provided at the distal end thereof with a reduced-diameter tip 44 (see FIGS. 3 and 6). Also integral with the top wall 31 and depending therefrom are a pair of elongated posts 45, respectively provided at the distal ends thereof with reduced diameter tips 46 (see FIGS. 3, 4, and 11). The distal edge of the skirt 32 is recessed along the inner surface thereof around the entire perimeter thereof to form a shoulder 47 (see FIG. 2). Formed in the top wall 31 adjacent to one side edge thereof is a rectangular opening 48 for a purpose to be described more fully below. Integral with the top wall 31 and depending therefrom respectively at opposite ends of the opening 48 are two short pins 49.

Figure 11:
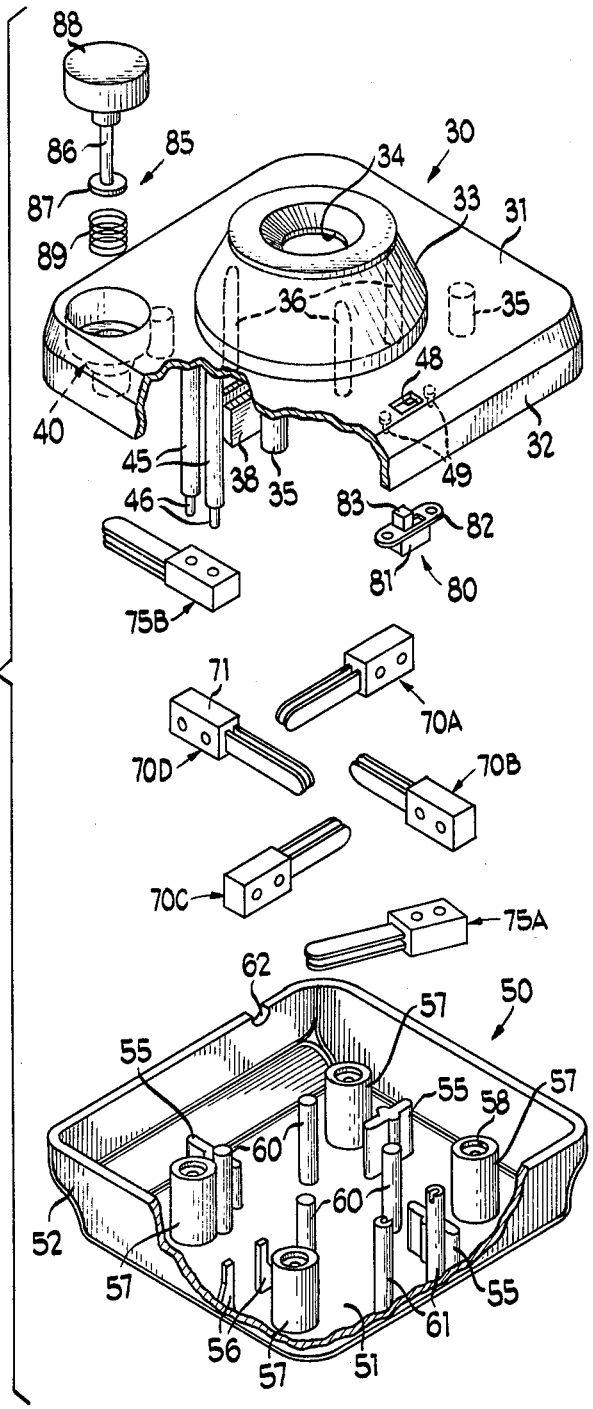
FIG. 11 is an exploded view of the casing of the joystick controller of the present invention and the switches mounted therein, with portions of the casing broken away more clearly to illustrate the construction thereof.

The bottom or base 50 is also of unitary one-piece construction, preferably being molded of a suitable plastic material, and includes a generally rectangular bottom wall 51 provided around the perimeter thereof with an upstanding side wall 52. The side wall 52 is provided at the distal edge thereof with an upwardly projecting lip 53 around the entire perimeter thereof (see FIG. 2) designed to interfit with the recessed shoulder 47 on the cover 30 to close the outer casing 21 around the entire perimeter thereof. The bottom wall 51 is provided with a plurality of apertures therein in which are respectively received grommets 54 to provide cushioned mounting feet or pedestals for the casing 21. Integral with the bottom wall 51 and projecting upwardly therefrom are three retaining blocks 55, each being generally cruciform in transverse cross section, as is best illustrated in FIG. 11. Also integral with the bottom wall 51 and projecting upwardly therefrom are a pair of retaining lugs 56 (see FIGS. 3 and 11). Also integral with the bottom wall 51 and projecting upwardly therefrom respectively adjacent to the four corners thereof are four attachment tubes 57, each provided with a recess 58 in the distal end thereof and respectively receiving screws 59 therein. In use, the cover 30 and the base 50 are fitted together in an assembled condition illustrated in FIGS. 2 and 5–7, with the shoulder 57 of the skirt 32 interfitted with the lip 53 of the side wall 52, and with the lower ends of the attachment lugs 35 respectively fitted in the recesses 58 of the attachment tubes 55, the screws 59 being threadedly engaged with the attachment lugs 35 fixedly to hold the parts of the casing 21 together.

Also integral with the bottom wall 51 and projecting upwardly therefrom respectively adjacent to the attachment tubes 57 are four retaining pins 60, one of the retaining pins 60 being formed integrally with the adjacent one of the attachment tubes 57 (see FIG. 11). Two retaining pins 61 are integral with the bottom wall 51 adjacent to one side edge thereof and project upwardly therefrom. Formed in the upper edge of the side wall 52 is an arcuate notch 62 in which is seated a grommet fitting 66 for a cable 65 carrying a plurality of wires 67 connected to the components of the joystick controller 20 in a manner which is described in greater detail in my copending U.S. application Ser. No. 423,812, filed Sept. 27, 1982.

Disposed within the casing 21 are four direction control switches 70, which are differentiated by the suffixes A–D and are substantially identical in construction. Each of the switches 70 is a leaf switch having a rectangular body 71 molded about the ends of a stiffening blade 72 and fixed and movable contacts 73 and 74 in a known manner. The switch bodies 71 are respectively frictionally fitted in the receptacles 37A–D (see FIG. 3) between the walls 38 thereof and against the seat rib 39. Also disposed in the enclosure 21 are two fire control switches 75, differentiated by the suffixes A and B. Each of the switches 75 is also a leaf switch having a rectangular body 76 molded about the ends of a stiffening blade 77 and fixed and movable contacts 78 and 79. Each of the switch bodies 76 has two bores therethrough, the bores of the switch 75A respectively frictionally receiving therein the tips 44 of the posts 43, and the bores of the switch 75B respectively frictionally receiving therein the tips 46 of the posts 45 (see FIG. 3) for fixedly positioning the switches 75A and B in place. The parts of the cover 30 and the base 50 are so dimensioned and arranged that when they are connected together in their assembled condition, the retaining blocks 55 respectively engage the switch bodies 71 of the switches 70A, B, and D, while the retaining lugs 56 engage the body 71 of the switch 70C (see FIGS. 5–7) for cooperation with the receptacles 37 substantially immovably to hold the switches 70 in place.

There is also provided a slide switch 80 (see FIGS. 1, 5, and 11) having a body 81 provided with end flanges 82 and an actuator 83. The pins 49 of the cover 30 are frictionally fitted in complementary apertures in the flanges 82 to position the slide switch 80 in a mounted configuration, best illustrated in FIG. 5, in which the actuator 83 projects upwardly through the opening 48 in the cover top wall 31. When the cover 30 and base 50 are assembled together, the retaining pins 61 respectively engage the flanges 82 substantially immovably to hold the slide switch 80 is place.

Disposed in the cylindrical bushing 40 is an actuator assembly, generally designated by the numeral 85 (see FIG. 4), which includes an elongated shaft 86 provided at the inner end thereof with an enlarged-diameter disk 87 and provided at the outer end thereof with a push button 88. In use, the shaft 86 is disposed in the reduced diameter portion 42 of the bushing 40, with the push button 88 disposed in the large diameter portion 41. The disk 87 has a diameter such that it will not fit through the bore in the reduced diameter portion 42. A helical compression spring 89 is disposed in the large diameter portion 41 of the bushing 40 in surrounding relationship with the shaft 86 and bears against the push button 88 resiliently to urge the actuator assembly 85 outwardly to a normal rest position, illustrated in FIG. 4, wherein the disk 87 bears against the inner end of the cylindrical bushing 40 and the push button 88 projects outwardly beyond the top wall 31 of the cover 30 for operation by a user.

Referring now to FIGS. 2, 6, 8, and 10, the joystick controller 20 includes a support module, generally designated by the numeral 90, having a cover 91 and a bottom 105 which cooperate to form a closed housing. The cover 91 is generally in the shape of an inverted cup having a circular end wall 92 provided with a circular aperture 93 therein centrally thereof, and integral around the perimeter thereof with a side wall having four sloping side sections 94 and four sloping corner sections 96, all terminating at a depending skirt 95 generally rectangular in outline. The inner surface of the skirt 95 is recessed to define a seat shoulder 97 at the upper end thereof around the entire perimeter thereof (see FIG. 2). Formed in each of the corner sections 96 adjacent to the lower end thereof is a notch 98. Formed on the inner surface of each wall portion of the skirt 95 is an elongated shallow recess 99 (see FIG. 2).

A diaphragm assembly 100 is disposed in the support module 90. More particularly, the diaphragm assembly 100 includes a rectangular rigid plate 101, preferably formed of metal, having a circular aperture through the center thereof in which is received a flexible rubber diaphragm 102. Fixedly inserted in the diaphragm centrally thereof is a cylindrical bushing 103, which may be formed of metal. The diaphragm assembly 100 is disposed within the cover 91 with the peripheral edges of the plate 101 seated against the shoulder 97, and with the corners of the plate 101 respectively received in the notches 98. A washer 104 is provided beneath the diaphragm assembly 100.

The bottom 105 holds the diaphragm assembly 100 in place. More particularly, the bottom 105 has a generally rectangular flat bottom wall 106 provided around the perimeter thereof with an integral upstanding peripheral flange 107 dimensioned to frictionally fit within the skirt 95 of the cover 91 for cooperation therewith to enclose the diaphragm assembly 100 and the washer 104. The bottom wall 106 has a circular aperture 108 therein centrally thereof. Integral with each of the wall portions of the peripheral flange 107 is a laterally outwardly projecting rib 109 dimensioned to be snap fitted into a corresponding one of the recesses 99 in the cover skirt 95 securely to hold the parts together. It will be noted that the height of the peripheral flange 107 is such that when the cover 91 and the bottom 105 are snap fitted together, the peripheral flange 107 cooperates with the shoulder 97 securely to clamp the plate 101 therebetween fixedly to hold the diaphragm assembly 100 in place. Respectively extending across the corners of the peripheral flange 107 are webs **109*a* (see FIG. 10). Similar webs (not shown) are preferably provided across the corner sections 96 of the cover 91 and cooperate with the webs 109*a* to provide more positive support for the plate 101**.

In use, the support module 90 is disposed in the turret 33 of the cover 30, the positioning lugs 36 and the inner one of the posts 43 engaging the skirt 95 accurately to position the support module 90 and prevent lateral movement thereof. A washer 126 is preferably provided between the support module cover 91 and the top of the turret 33 to facilitate proper seating of the support module 90. When thus assembled, the bottom wall 106 extends below the top wall 31 of the cover 30 and is engaged by the retaining pins 60 when the cover 30 and the base 50 are assembled together, substantially immovably to hold the support module 90 in place. When the support module 90 is thus mounted in place, the sides of the skirt 95 bear respectively against the inner edges of the receptacle walls 38 for cooperation with the pins 39 as to restrain the switch bodies 71 against movement longitudinally of the receptacles 37.

Mounted in the support module 90 is a handle assembly, generally designated by the numeral 110 which includes an elongated tube 111 having a reduced diameter inner end 112. Disposed in surrounding with relationship and fixedly secured to the outer end of the tube 111 is a handle 113 having a cylindrical bore 114 extending axially therethrough, the bore 114 having at the outer end thereof an intermediate diameter portion 115 and a large diameter portion 116. Extending axially through the handle 113 and the tube 111 is an elongated rod or shaft 117 having secured to the outer end thereof a push button 118 dimensioned to be received within the large diameter portion 116 of the bore 114. Disposed in the intermediate diameter portion 115 of the bore 114 is a helical compression spring 119 which bears against the push button 118, resiliently to urge it outwardly to a normal rest position wherein the push button 118 projects upwardly beyond the adjacent end of the handle 113 a predetermined distance for access by a user.

In use, the tube 111 is received downwardly through the aperture 34 in the cover 30 and the aperture 93 in the support module cover 91, with the reduced diameter end 112 of the tube 111 being received through the bushing 103, the washer 104 and the aperture 108 in the support module bottom 105. The juncture between the reduced diameter end 112 of the tube 111 and the main body thereof forms an annular shoulder which bears against the upper end of the bushing 103 to support the handle assembly 110 and limit the depth of insertion thereof, so that the inner end of the tube 111 projects a predetermined distance below the support module 90.

Disposed in surrounding relationship with the inner end of the tube 111 is a cylindrical actuator 120, being retained in place by a E-ring 121. Disposed in surrounding relationship with the reduced diameter end 112 of the tube 111 above the actuator 120 is a helical compression spring 112, which extends upwardly through the aperture 108 in the support module bottom 105 and bears against the washer 104, resiliently to hold the handle assembly 110 in its fully inserted position illustrated in FIG. 2. The actuator 120 is dimensioned and positioned so that it engages the movable contacts 74 of each of the direction control switches 70A–D (see FIG. 3). When the handle assembly 110 is centered in its normal rest position, all of the switches 70 are in their normally-open condition. The flexible diaphragm 112 accommodates tilting movement of the handle assembly 110 for closing one or more of the switches 70 in a well known manner, and as is explained in greater detail in the aforementioned copending U.S. application Ser. No. 423,812.

The inner end of the shaft 117 projects a predetermined distance below the inner end of the tube 111 and is fixedly secured to a large circular actuator 125, which is held against the inner end of the tube 111 by the action of a spring 119, thereby to limit the projection of the push button 118 above the end of the handle 113. The actuator 125 is dimensioned and positioned so that it engages the movable contact 79 of the fire control switch 75A (see FIGS. 2 and 6) in its normally open condition. It will be appreciated that when the push button 118 is depressed, the actuator 125 closes the contacts of the switch 75A.

The other fire control switch 75B is positioned so that the movable contact 79 thereof is disposed in engagement with the disk 87 of the actuator assembly 85. Thus, it will be appreciated that when the push button 80 is depressed, the contacts of the switch 75A are closed, in a well known manner. Preferably, the bodies 76 of the fire control switches 75A and B are so dimensioned that, in use, they bear against the bottom wall 51 of the enclosure base 50 in the assembled condition thereof, for cooperation with the posts 43 and 45 substantially immovably to hold the switches 75A and B in place.

The selector switch 80 is connected in circuit with the fire control switches 75A and B so that, depending upon the position of the selector switch 83, one or the other of the switches 75A and B is enabled, all as is more fully described in the aforementioned copending application Ser. No. 423,812.

In assembly of the joystick controller 20, the support module 90 is first assembled and is inserted in place with the washer 126 in the turret 33. The shaft 86 of the actuator assembly 85 is inserted upwardly through the bushing 40, and then the spring 89 is disposed in surrounding relationship with the outer end of the shaft 86 and the push button 88 is press fitted onto the shaft 86. The switches 70, 75 and 80 are all interconnected and then all but 75A are inserted in place in the receptacles 37, on the posts 45 and on the pins 49. The tube 111 is then inserted into position in the support module 90, after which the spring 122, the actuator 120 and the E-ring 121 are mounted in place thereon. Then the shaft 117, with the push button 118 thereon along with the spring 119 are disposed in the handle assembly 110, after which the actuator 125 is press fitted onto the shaft 117. The fire control switch 75A may then be mounted on the posts 45. The base 50 may then be assembled with the cover 30, using the screws 59, all of the parts being securely held in position in the manner described above.

Accordingly, it will be appreciated that the present invention has provided a unique joystick controller of simple and economical construction, wherein the joystick support is modular in construction, the module parts being assembled without the use of fasteners, and the module and the other parts of the assembly being held accurately and immovably in position substantially without the use of fasteners, the only fasteners used being those which hold the two parts of the outer casing together.

I claim:

1. In a joystick controller including an enclosure, direction control switches in the enclosure and handle means coupled to the enclosure for actuating the switches, the improvement comprising: a support module mounted as a unit within the enclosure for tiltably supporting the handle means, said support module including a housing having a passage therethrough for accommodating the handle means in a mounted configuration extending through said housing, flexible diaphragm means fixedly mounted in said housing, support means carried by said diaphragm means and engaging the handle means for axial and lateral support thereof in the mounted configuration thereof, the flexibility of said diaphragm means accommodating universal tilting movement of said support means and the handle means for actuation of the switches.

2. The joystick controller of claim 1, wherein said support module includes plural parts interconnected without the use of separate fasteners.

3. The joystick controller of claim 1, wherein said support module is substantially immovably supported within the enclosure without the use of fasteners.

4. The joystick controller of claim 1, wherein said support module housing has two parts snap-fitted together.

5. The joystick controller of claim 4, wherein said diaphragm means is clamped between the two parts of said support module housing.

6. The joystick controller of claim 5, wherein said diaphragm means has a central opening therethrough disposed in registry with said passage and accommodating the handle means therethrough.

7. The joystick controller of claim 5, and further including retaining means carried by the handle means and cooperating with said support means resiliently to inhibit axial movement of the handle means from its operating position.

8. The joystick controller of claim 1, wherein said housing has a plurality of slots therein, said diaphragm means having portions thereof respectively disposed in said slots fixedly to position said diaphragm means within said housing.

9. A joystick controller comprising a two-part enclosure, one of said enclosure parts having a plurality of receptacles formed therein, a plurality of switch assemblies respectively received in said receptacles, said other enclosure part having a plurality of projections thereon, said enclosure parts being disposable in an assembled condition for cooperation to enclose said switches with said projections respectively cooperating with said receptacles substantially immovably to retain said switches in place, and handle means tiltably carried by said enclosure for engagement with said switches to effect actuation thereof.

10. The joystick controller of claim 9, wherein said enclosure includes a bottom part and a cover part.

11. The joystick controller of claim 9, wherein said one enclosure part includes a plurality of receptacle-forming structures, each of said structures including a pair of laterally spaced-apart walls and a seat member disposed between said walls, each of said switch assemblies being disposed frictionally between the walls of the associated receptacle-forming structure in engagement with the seat member thereof.

12. The joystick controller of claim 9, and further including a switch structure disposed within said enclosure and having a pair of openings therein, said one part of said enclosure having a pair of pins projecting therefrom and respectively received in said openings in said switch structure for fixedly mounting said switch structure in place.

13. The joystick controller of claim 9, wherein said one part of said enclosure has a support receptacle formed therein, said handle means including a support structure disposed in said support receptacle, said other part of said enclosure having a plurality of retaining members thereon disposed in engagement with said support structure when said housing parts are disposed in their assembled condition for cooperation with said support receptacle substantially immovably to retain said support structure in place.

14. The joystick controller of claim 13, wherein said one enclosure part further includes a plurality of positioning members disposed in engagement with said support structure for preventing lateral movement thereof.

15. The joystick controller of claim 9, wherein each of said enclosure parts is of unitary one-piece construction.

16. The joystick controller of claim 9, wherein said enclosure parts respectively have first and second coupling members thereon disposed in engagement with each other when said housing parts are in the assembled condition thereof, and further including fastening means interconnecting said first and second coupling parts.

17. The joystick controller of claim 16, wherein each of said first coupling parts is interfitted with the associated second coupling part.

18. The joystick controller of claim 9, wherein said projections are respectively disposed in engagement with said switch assemblies.

19. A joystick controller comprising a two-part enclosure, one of said enclosure parts having a plurality of switch receptacles and a support receptacle formed therein, the other of said enclosure parts having a plurality of first projections and a plurality of second projections thereon; a plurality of switch assemblies respectively received in said switch receptacles; a support module received as a unit in said support receptacle, said support module including a housing having a passage therethrough, and flexible diaphragm means fixedly mounted in said housing, said enclosure parts being disposable in an assembled condition for cooperation to enclose said switches and said support module; said first projections respectively cooperating with said switch receptacles when said enclosure parts are in their assembled condition substantially immovably to retain said switch assemblies in place; said second projections cooperating with said support receptacle when said enclosure parts are in their assembled condition substantially immovably to retain said support module in place; and handle means disposed in said passage and supported by said flexible diaphragm means for tilting movement to engage said switches for effecting actuation thereof.

20. The joystick controller of claim 19, wherein said one enclosure part has a plurality of positioning members thereon disposed in engagement with said support module for preventing lateral movement thereof.

21. The joystick controller of claim 19, wherein said support module has a plurality of parts interconnected without the use of fasteners, said support module being fixedly secured within said enclosure without the use of fasteners.

22. The joystick controller of claim 19, wherein said first projections are respectively disposed in engagement with said switch assemblies and said second projections are disposed in engagement with said support module.

23. The joystick controller of claim 19, and further including switch structure disposed in said enclosure and having a pair of openings therein, said one enclosure part having a pair of pins projecting therefrom and respectively disposed in said openings for fixedly holding said switch structure in place.

* * * * *